United States Patent [19]

Watahiki

[11] 3,981,269

[45] Sept. 21, 1976

[54] FIXING DEVICE FOR ELECTROPHOTOGRAPHIC DUPLICATING MACHINES

[75] Inventor: Kenichi Watahiki, Ebina, Japan

[73] Assignee: Fuji Xerox Co., Ltd., Tokyo, Japan

[22] Filed: Feb. 3, 1975

[21] Appl. No.: 546,762

[30] Foreign Application Priority Data

Mar. 20, 1974 Japan ..... 49-31159[U]

[52] U.S. Cl. ..... 118/60; 118/70; 432/60

[51] Int. Cl.[2] ..... G03G 15/20

[58] Field of Search ..... 118/60, 70, 104, 203; 432/60, 228; 355/15; 427/22

[56] References Cited

UNITED STATES PATENTS

| | | | |
|---|---|---|---|
| 2,889,758 | 7/1959 | Bolton | 355/15 X |
| 3,256,002 | 6/1966 | Hudson | 118/60 |
| 3,796,183 | 3/1974 | Thettu | 432/60 X |

*Primary Examiner*—John P. McIntosh
*Attorney, Agent, or Firm*—Gerald J. Ferguson, Jr.; Joseph J. Baker

[57] ABSTRACT

A fixing device for use in an electrophotographic duplicating machine, the fixing device comprising heat rollers through which is fed a copy medium supporting a toner image, the heat rollers fixing the toner image to the support medium, a feed member for feeding an offset preventive solution to at least the surface of the image-side heat roller, a transfer member for transferring the offset preventive solution to the feed member, a feed roller and an offset preventive solution reservoir for feeding the offset preventive solution to the transfer member, a blade for wiping off viscous material deposited on the surface of the image-side heat roller, and a moisture absorbent member for preventing flow of viscous material wipe by the blade, the moisture absorbent member having a base portion interposed between the transfer member and the feed member.

4 Claims, 2 Drawing Figures

FIXING DEVICE FOR ELECTROPHOTOGRAPHIC DUPLICATING MACHINES

BACKGROUND OF THE INVENTION

1. Field of the Invention

This invention relates to a fixing device for electrophotographic duplicating machines, and more particularly to an offset preventive device for an image fixer used in such machines.

2. Discussion of the Prior Art

It is well known, in electrophotographic copying machines to transfer a powder image onto a copy medium from a xerographic plate and heat it in a heat-contact fixer to a viscous state so that the image may be fixed to the copy medium. However, there is a tendency, when using heat rollers, for a portion of the image disposed on the copy medium to deposit on the surface of the contact heat roller. As a result, the viscous image portions, which have been deposited from the copy medium in the preceding revolution of the heat roller, are partially transferred to the copy medium again on the succeeding revolution of the heat roller. At the same time a fresh viscous image portion is transferred to the heat roller as in the preceding revolution thereof. This phenomenon is generally known as "offset" and, in order to minimize it, it is known to coat the surfaces of the heat roller with an offset preventive material such as a fluorine-containing resin and to provide an offset preventive solution feed device for supplying offset preventive solution such as a silicon oil to the offset preventive material of the heat roller.

However, the offset preventive solution feed device must both feed the offset preventive solution and, at the same time, remove depositions of viscous developing agent from the heat roller. However, the viscous developing agent which has been removed from the heat roller by the offset preventive solution feed member is accumulated thereon during repeated operations, thereby clogging the heat resistant fiber material of the offset preventive solution feed member to such a degree as to make it very difficult to supply the desired offset preventive solution. The viscous developing agent which accumulates on the offset preventive solution feed member tends to deposit again on the heat roller, thus causing further problems.

SUMMARY OF THE INVENTION

With the foregoing in view, the present invention has as its object the provision of a fixing device suitable for use in electrophotographic duplicating machines where the device is capable of preventing clogging of the offset preventive solution feed member and extending the service life thereof, thereby facilitating the feed and recovery of the offset preventive solution and enhancing the offset preventive effects to obtain clear copies.

Other objects and advantages of this invention will become apparent upon reading the appended claims in conjuncton with the following detailed description and the attached drawings.

DETAILED DESCRIPTION OF PREFERRED EMBODIMENT

Figure 1:
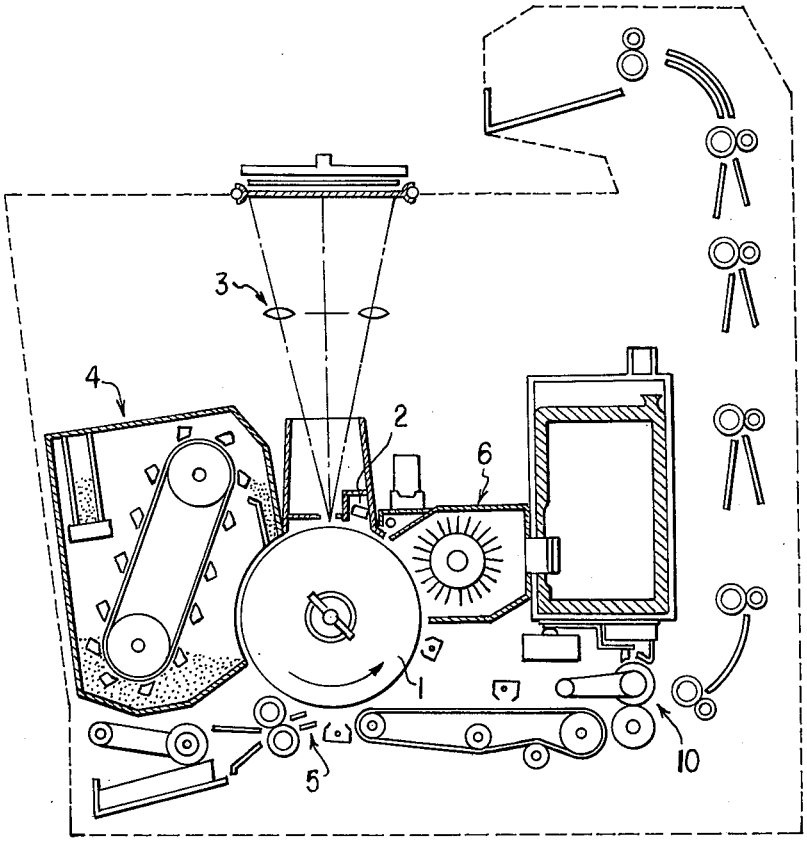
FIG. 1 is a diagrammatic view of an electrophotographic duplicating machine employing a fixing device in accordance with the invention.

Referring to FIG. 1, there is shown, by way of example, a duplicator machine employing a fixing device according to the invention. A drum is provided with a photoconductive layer on a conductive plate-like base structure and is adapted to rotate in the direction indicated by the arrow. The surface of drum 1 successively rotates past a charging position 2, exposure position 3, developing station 4, image transfer station 5 and a cleaning station 6. A powder image formed on drum 1 at developing station 4 is transferred onto a copy medium at image transfer station 5 and the copy medium is thereafter fed to a fixing device 10.

Figure 2:
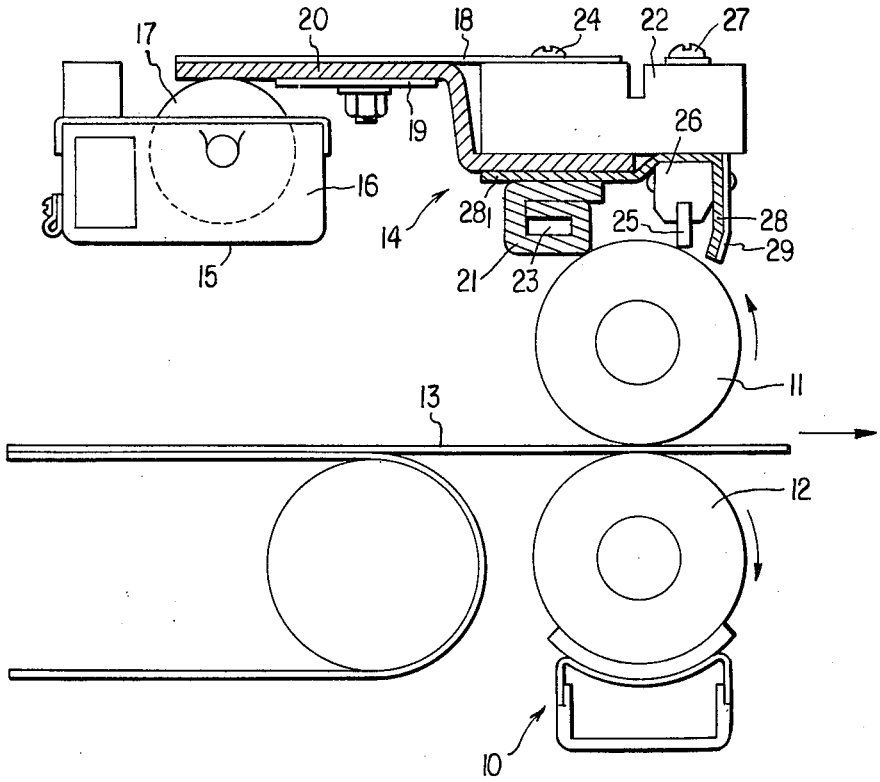
FIG. 2 is a schematic view of an illustrative fixing device according to the invention.

FIG. 2 shows a fixing device 10 according to the invention by way of diagrammatic sectional view, wherein fixing device 10 is provided with a pair of heat rollers 11 and 12 through which a transfer or copy medium 13 is passed for fixing the toner image. The heat rollers 11 and 12 are coated with a suitable material which repels a viscous material, as stated hereinbefore. The coated surfaces of the heat rollers are supplied with an offset preventive solution such as a silicon oil from an offset preventive means 14 which is provided on the fixing device 10. More particularly, an offset preventive solution 16 which is pooled in a reservoir tray 15 is fed by means of a feed roller 17 to an offset preventive solution transfer member 20 grippingly interposed between a base plate 18 and a retaining plate 19 of the offset preventive means 14. The transfer member 20 is preferably of a moisture absorbent material such as felt and provided with a moisture abosorbent feed member 21 disposed on a base portion $28_1$ of a moisture absorbent member 28 to be described in more detail hereinafter. Transfer member 20, feed member 21, and base portion $28_1$ are secured together with a weight 22 to base plate 18 by means of a stud-off 23 and a screw 24. The offset preventive solution which is soaked by transfer member 20 is transferred to the feed member 21 through base portion $28_1$ of moisture absorbent member 28 for supply to heat roller 11. Transfer member 20 and moisture absorbent member 28 are formed, for example, from felt of a heat resistant fluorine-containing resin fiber.

In order to wipe off a viscous material such as fused toner on the surface of the heat roller 11 prior to the supply thereto of the offset preventive solution, a blade 25 is mounted by means of a support member 26. Blade 25 is in contacting relationship with heat roller 11. Support member 26 is secured to weight 22 by means of a screw 27. Blade 25 is formed, for example, from a heat resistant flexible material such as silicon rubber, a fluorine-containing rubber or the like.

Moreover, support member 26 has secured thereto a middle portion of moisture absorbent member 28 together with a support plate 29, the fore end portion of the moisture absorbent member 28 being located in a position proximal to heat roller 11 so as to prevent flow around the roller surface of the fused toner or the oil which has been wiped off by blade 25. The foregoing is also illustrated in FIG. 2 where moisture absorbent member 28 is shown as slightly spaced from roller 11 where the spacing is somewhat exaggerated for purposes of illustration. At the same time, moisture absorbent member 28 accelerates the supply of offset preventive solution to transfer member 20 and feed member 21 through its base portion $28_1$.

With the invention as described above, toner which is deposited in a fused state on the surface of heater roller 11, as copy medium 13 is passed through heat fixing rollers 11 and 12, is removed by blade 25, thus lessening clogging of transfer member 20 and extendings its service life for a considerable degree. The invention also accelerates the supply of offset preventive solution from the moisture absorbent member 28 to transfer member 20 and feed member 21 and to give increased offset preventive effects to produce clear copies.

What is claimed is:

1. A fixing device for use in electrophotographic copying machine, said fixing device comprising rollers through which is fed a copy medium supporting a toner image, one of said rollers being an image-side heat roller for fixing said toner image to support medium, said one roller having a substantially vertical imaginary plane extending through the axis thereof;

means for rotating said one roller in a predetermined direction;

feed means for applying an offset preventing solution to at least the surface of the image-side heat roller, said feed means being disposed on one side of said plane;

a blade disposed in front of said feed means in the direction of rotation of said one roller and on the side of said plane opposite said one side, said blade wiping viscous material deposited on the surface of said image-side heat roller to thereby prevent said viscous material from reaching said feed means;

moisture absorbent means disposed in front of said blade in the direction of rotation of said one roller, said moisture absorbent means preventing flow around said image-side roller of viscous material wiped by said blade and being disposed adjacent to and slightly spaced from said image-side roller and having a portion in contact with said feed means.

2. A fixing device as in claim 1 wherein said feed means includes a moisture absorbent feed member in contact with said image-side roller for applying said offset preventing solution;

a reservoir of said solution; and moisture absorbent transfer means for transferring said solution to said feed roller.

3. A fixing device as in claim 2 where said portion of said moisture absorbent means for preventing flow around said image-side roller is interposed between said moisture absorbent feed member and said moisture absorbent transfer means.

4. A fixing device for use in an electrophotographic duplicating machine, said fixing device comprising rollers through which is fed a copy medium supporting a toner image, one of said heat rollers being an image-side heat roller for fixing said toner image to said support medium, said one roller having a substantially vertical imaginary plane extending through the axis thereof, means for rotating said one roller in a predetermined direction;

a feed member for feeding an offset preventive solution to at least the surface of the image-side heat roller, said feed means being disposed on one side of said plane, a transfer member for transferring the offset preventive solution to said feed member, a feed roller and an offset preventive solution reservoir for feeding the offset preventive solution to said transfer member, a blade disposed in front of said feed means in the direction of rotation of said one roller and on the side of said plane opposite said one side, said blade wiping off viscous material deposited on the surface of said image-side heat roller, and a moisture absorbent member disposed in front of said blade in the direction of rotation of said one roller, said moisture absorbent means preventing flow of viscous material wiped by said blade and having a base portion interposed between said transfer member and said feed member.

* * * * *